US010800436B2

(12) United States Patent
Nishimura et al.

(10) Patent No.: US 10,800,436 B2
(45) Date of Patent: Oct. 13, 2020

(54) RAILCAR STEERING BOGIE

(71) Applicant: KAWASAKI JUKOGYO KABUSHIKI KAISHA, Kobe-shi, Hyogo (JP)

(72) Inventors: Takehiro Nishimura, Kobe (JP); Yoshi Sato, Sanda (JP); Yukitaka Taga, Kobe (JP); Yousuke Tsumura, Kobe (JP); Keiichiro Kamura, Kobe (JP); Fumikazu Kounoike, Kakogawa (JP); Koichi Murata, Kobe (JP); Francois Olivier Uchida, Kobe (JP); Yuta Yoshimatsu, Kobe (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 264 days.

(21) Appl. No.: 16/063,498

(22) PCT Filed: Dec. 5, 2016

(86) PCT No.: PCT/JP2016/086055
§ 371 (c)(1),
(2) Date: Jun. 18, 2018

(87) PCT Pub. No.: WO2017/104464
PCT Pub. Date: Jun. 22, 2017

(65) Prior Publication Data

US 2018/0370550 A1 Dec. 27, 2018

(30) Foreign Application Priority Data

Dec. 18, 2015 (JP) ..... 2015-247730

(51) Int. Cl.
*B61F 5/46* (2006.01)
*B61F 5/30* (2006.01)
*B61F 5/32* (2006.01)

(52) U.S. Cl.
CPC ..... *B61F 5/46* (2013.01); *B61F 5/302* (2013.01); *B61F 5/32* (2013.01)

(58) Field of Classification Search
CPC .... B61F 5/302; B61F 5/32; B61F 5/46; B61F 5/52; B61F 3/02; B61F 5/305; B61F 5/325; B61F 5/36; B61F 5/50
See application file for complete search history.

(56) References Cited

U.S. PATENT DOCUMENTS

2010/0229753 A1* 9/2010 Kikko ..... B61F 5/44 105/4.4
2014/0137765 A1 5/2014 Nishimura et al.
(Continued)

FOREIGN PATENT DOCUMENTS

CN 103635373 A 3/2014
JP WO2009/038068 A1 1/2011
(Continued)

*Primary Examiner* — Mark T Le
(74) *Attorney, Agent, or Firm* — Oliff PLC

(57) ABSTRACT

A railcar steering bogie includes: a bogie frame including a cross beam; pair of axles; axle boxes accommodating bearings; axle box suspensions each including a coupling member coupling the corresponding axle box and bogie frame while allowing relative displacement in a car longitudinal direction; plate spring extending in the car longitudinal direction and including car longitudinal direction end portions extending obliquely upward along the car longitudinal direction and supported above the respective axle boxes and a car longitudinal direction middle portion unfixedly arranged under the cross beam; support seats including respective inclined upper surfaces and supporting the both respective longitudinal direction end portions of the plate spring; and gap bodies each provided between an upper surface of the corresponding axle box suspension and a lower surface of the corresponding support seat and config-
(Continued)

ured to allow displacement of the axle box suspension and the support seat in the car longitudinal direction.

10 Claims, 8 Drawing Sheets

(56) References Cited

U.S. PATENT DOCUMENTS

| | | | |
|---|---|---|---|
| 2014/0144347 | A1 | 5/2014 | Nishimura et al. |
| 2015/0083019 | A1 | 3/2015 | Nishimura et al. |
| 2015/0353105 | A1 | 12/2015 | Nishimura et al. |
| 2016/0023670 | A1 | 1/2016 | Sato et al. |
| 2016/0304102 | A1 | 10/2016 | Okumura et al. |

FOREIGN PATENT DOCUMENTS

| | | | | |
|---|---|---|---|---|
| JP | 2013-035536 | A | | 2/2013 |
| JP | 2014-88176 | A | | 5/2014 |
| JP | 2014-133481 | A | | 7/2014 |
| JP | 2015-107773 | A | | 6/2015 |
| JP | 5779280 | B2 | | 9/2015 |
| WO | WO 2014109280 | | * | 7/2014 |
| WO | 2014/136449 | A1 | | 9/2014 |

* cited by examiner

RAILCAR STEERING BOGIE

TECHNICAL FIELD

The present invention relates to a railcar bogie, particularly to a railcar steering bogie having improved curved line passing performance.

BACKGROUND ART

A bogie supporting a carbody of a railcar and traveling on a rail is provided under a floor of the carbody. Typically, the bogie is constituted by: a bogie frame including a cross beam and side sills; axle boxes accommodating bearings supporting wheelsets; and axle box suspensions supporting the axle boxes such that the axle boxes are displaceable relative to the bogie frame in an upward/downward direction. Unlike such bogie, a bogie including a plate spring (hereinafter simply referred to as a "plate spring bogie") is being developed as in, for example, PTLs 1 and 2. The plate spring bogie of PTL 1 includes plate springs extending in a car longitudinal direction, and car longitudinal direction middle portions of the plate springs support the cross beam arranged above the plate springs. Further, each of both car longitudinal direction end portions of the plate spring extends obliquely upward in the car longitudinal direction and is located above the axle box. A spring seat including an inclined upper surface is fixed to an upper portion of the axle box, and the car longitudinal direction end portion of the plate spring is supported by the upper surface of the spring seat through a gap body. Further, according to the plate spring bogie of PTL 2, an upper surface of a supporting member provided at the upper portion of the axle box is formed horizontally, and in accordance with this, both car longitudinal direction end portions of the plate spring are also formed horizontally. According to these plate spring bogies, when vehicle occupancy increases, and a downward load of the carbody increases, the car longitudinal direction middle portion of the plate spring sinks downward. In accordance with this, both car longitudinal direction end portions of the plate spring move close to the cross beam.

CITATION LIST

Patent Literature

PTL 1: Japanese Laid-Open Patent Application Publication No. 2015-51763

PTL 2: Japanese Laid-Open Patent Application Publication No. 2014-88176

SUMMARY OF INVENTION

Technical Problem

There exists a steering bogie configured to be able to smoothly pass through a curved section by changing the direction of a wheelset in a yawing direction to reduce an attack angle between a wheel and a rail. According to such steering bogie, for example, the bogie frame and the axle box are coupled to each other by a link mechanism so as to be relatively displaceable, and the direction of the wheelset is changed by the relative displacement of the axle box. Thus, the curved line passing performance is improved. If such steering function is given to the plate spring bogie of PTL 1 or 2, the following problems occur.

To be specific, according to the plate spring bogie of PTL 1, the upper surface of the spring seat is inclined, and each of both car longitudinal direction end portions of the plate spring is supported by the upper surface of the spring seat through a gap body capable of performing shearing deformation. To be specific, the gap body performs elastic deformation along the inclined surface of the spring seat. Therefore, when the axle box is displaced in the car longitudinal direction through the link mechanism during steering (for example, when the axle box is displaced toward a middle side of the bogie in the car longitudinal direction, i.e., toward the cross beam), the gap body performs the elastic deformation, and a horizontal component of a carbody support load acts on the axle box through the spring seat outward in the car longitudinal direction. Therefore, the movement of the axle box inward in the car longitudinal direction is inhibited. As a result, the steering function deteriorates.

According to the plate spring bogie of PTL 2, since both car longitudinal direction end portions of the plate spring extend horizontally, the movement of the axle box during the above-described steering is not inhibited. However, to make both car longitudinal direction end portions of the plate spring horizontal, the plate spring needs to be bent. In this case, stress concentrates on a bent portion of the plate spring, and this may reduce the strength of the plate spring.

An object of the present invention is to provide a railcar steering bogie which does not inhibit the movement of a steering axle when passing through a curved line, without deteriorating the strength of a plate spring.

Solution to Problem

A railcar steering bogie of the present invention includes: a bogie frame including a cross beam supporting a carbody; a pair of axles arranged along a car width direction; axle boxes accommodating respective bearings rotatably supporting the respective axles; axle box suspensions each including a coupling member coupling the corresponding axle box and the bogie frame while allowing relative displacement of the bogie frame and the axle box in a car longitudinal direction; a plate spring extending in the car longitudinal direction and including both car longitudinal direction end portions extending obliquely upward along the car longitudinal direction and supported above the respective axle boxes and a car longitudinal direction middle portion arranged under the cross beam so as not to be fixed to the cross beam; support seats including respective inclined upper surfaces and supporting the both respective longitudinal direction end portions of the plate spring; and gap bodies each provided between an upper surface of the corresponding axle box suspension and a lower surface of the corresponding support seat and configured to allow displacement of the axle box suspension and the support seat in the car longitudinal direction.

According to the present invention, even when the axle box and the bogie frame are relatively displaced in the car longitudinal direction, the gap body allows such displacement, so that the support seat supporting the end portion of the plate spring can be prevented from moving in conjunction with the axle box. With this, even when the axle box and the bogie frame are relatively displaced, the increase in the horizontal component of the carbody support load can be suppressed, and therefore, a case where the support seat inhibits the movement of the axle box in the car longitudinal direction can be suppressed. Further, the upper surfaces of the support seats are inclined. Therefore, without bending both longitudinal direction end portions of the plate spring, both longitudinal direction end portions extending obliquely can be supported by the respective support seats. On this account, the deterioration of the strength of the plate spring can be suppressed.

Advantageous Effects of Invention

The present invention can provide a railcar steering bogie which does not inhibit the movement of a steering axle when passing through a curved line, without deteriorating the strength of a plate spring.

The above object, other objects, features, and advantages of the present invention will be made clear by the following detailed explanation of preferred embodiments with reference to the attached drawings.

DESCRIPTION OF EMBODIMENTS

Figure 1:
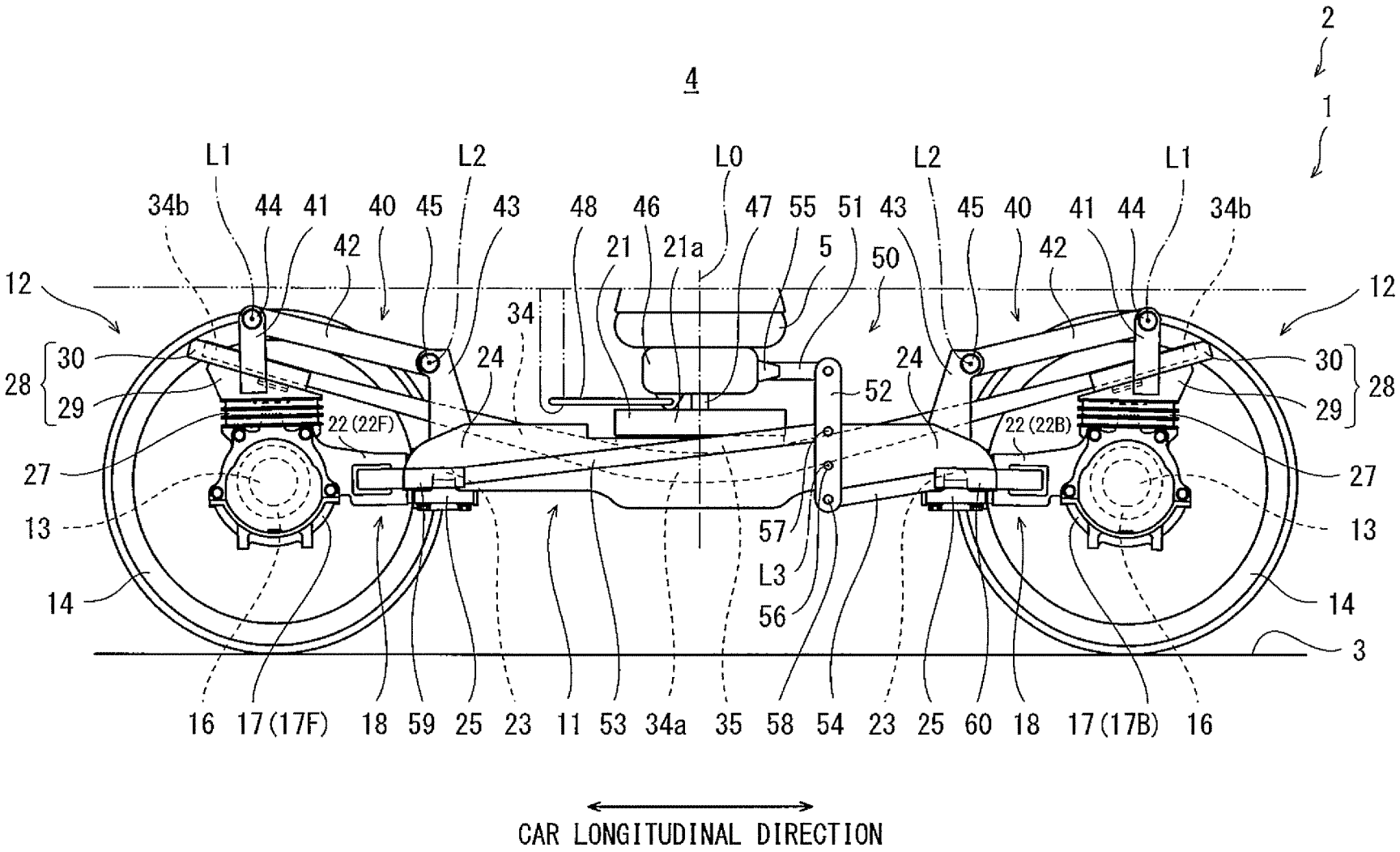
FIG. 1 is a side view showing a railcar steering bogie according to Embodiment 1.

Hereinafter, railcar steering bogies 1 and 1A of Embodiments 1 and 2 according to the present invention will be explained in reference to the drawings. It should be noted that directions stated in the following explanations are used for convenience of explanation, and directions and the like of components of the present invention are not limited. Further, each of the railcar steering bogies 1 and 1A explained below is just one embodiment of the present invention. Therefore, the present invention is not limited to the embodiments, and additions, deletions, and modifications may be made within the scope of the present invention.

Embodiment 1

A railcar 2 shown in FIG. 1 travels on a rail 3 laid on a ground surface or the like and includes a carbody 4 and a railcar steering bogie (hereinafter simply referred to as a "bogie") 1. The carbody 4 is formed in a substantially box shape that is long in a direction along the rail. The carbody 4 accommodates passengers, cargo, and/or the like. The bogie 1 is arranged under the carbody 4 and supports the carbody 4 through an air spring 5 serving as a secondary suspension. Hereinafter, the configuration of the bogie 1 will be explained in detail.

Bogie

As shown in FIG. 1, the bogie 1 includes a bogie frame 11, and the bogie frame 11 includes a cross beam 21. The cross beam 21 extends in a car width direction that is a leftward/rightward direction and supports the carbody 4 through a below-described bolster beam 46 and the air spring 5. It should be noted that unlike the configuration of a conventional railcar bogie, the bogie 1 does not include side sills. The cross beam 21 is configured such that a pair of square pipes (not shown) extending in the car width direction are connected to each other by connecting plates (not shown) arranged so as to be spaced apart from each other in the car width direction. A pair of front and rear wheelsets 12 extending in the car width direction are arranged at both respective car longitudinal direction sides of the cross beam 21, i.e., at respective front and rear sides of the cross beam 21. Each of the wheelsets 12 includes an axle 13 and a pair of wheels 14. Bearings 16 are provided at both respective car width direction end portions of the axle 13 so as to be located outside the respective wheels 14 in the car width direction. The bearings 16 rotatably support the axle 13 and are accommodated in respective axle boxes 17.

Axle box suspensions 18 hold the wheelset 12 at an appropriate position relative to the bogie frame 11 and support a load in the upward/downward direction. Each of the axle box suspensions 18 includes an axle beam 22 integrated with the axle box 17. The axle beam 22 that is a coupling member includes an axle beam main body portion 22*a* extending in the car longitudinal direction. A base end portion 22*b* of the axle beam main body portion 22*a* is coupled to the axle box 17. A tubular portion 22*c* is formed at a tip end portion of the axle beam main body portion 22*a*. The tubular portion 22*c* includes a cylindrical inner peripheral surface and is open toward both sides in the car width direction. A core rod 23 is inserted into the tubular portion 22*c* through a rubber bushing (not shown), and the core rod 23 is attached to a pair of receiving seats 24. The pair of receiving seats 24 are arranged at each of both car width direction end portions of the cross beam 21 so as to project in the car longitudinal direction. The receiving seats 24 constitute the bogie frame 11 together with the cross beam 21.

Fitting grooves 24*a* that are open downward are formed at car longitudinal direction outer sides of the receiving seats 24 (i.e., tip end sides of the receiving seats 24). Both car width direction end portions of the core rod 23 are fitted in the fitting grooves 24*a*. Further, with the core rod 23 fitted in the fitting groove 24*a*, the opening of the fitting groove 24*a* is closed by a lid body 25. With this, the core rod 23 is supported by the lid body 25 in the fitting groove 24*a*. The axle beam 22 attached as above is attached to the receiving seats 24 through the core rod 23 and the rubber bushing. The axle beam 22 pivots about the core rod 23 relative to the bogie frame 11 in a car upward/downward direction (i.e., a vertical direction). Further, by the elastic deformation of the rubber bushing, the axle beam 22 can pivot in the car width direction and can be displaced relative to the receiving seats 24 (i.e., the bogie frame 11) in the car longitudinal direction. As above, the axle beam 22 can move relative to the bogie frame 11 in the car upward/downward direction, the car width direction, and the car longitudinal direction. By moving the axle beam 22, the axle box 17 coupled to the base end portion 22*b* can move relative to the bogie frame 11 in the car upward/downward direction, the car width direction, and the car longitudinal direction.

Next, the configuration of an upper portion of the axle box 17 will be explained in reference to FIG. 2. An upper surface of the axle box 17 includes a horizontal surface formed substantially flat. A support seat 28 is provided at the horizontal surface of the axle box 17 through a gap body 27. The support seat 28 includes a support base 29 and a receiving member 30. The support base 29 is a base seat formed in a triangular shape (or a wedge shape) in a side view. An upper surface of the support base 29 is inclined downward toward the cross beam 21. Further, a lower surface of the support base 29 is formed parallel to the upper surface of the axle box 17. The gap body 27 is provided between the support base 29 and the axle box 17. The gap body 27 is a multi-layer rubber capable of performing elastic deformation (i.e., shearing deformation) in a horizontal direction. Upper and lower surfaces of the gap body 27 include respective horizontal surfaces parallel to each other. In the present embodiment, the gap body 27 is configured by: stacking three elastic plates 31 in the upward/downward direction; and interposing coupling seats 32 each between the adjacent elastic plates 31. Each of the elastic plates 31 is formed by adhering metal plates or resin plates to respective upper and lower surfaces of a rubber plate.

An insertion hole 27*a* is formed at a middle of the lower surface of the gap body 27, and an insertion pin 17*a* is formed on the upper surface of the axle box 17 at a position corresponding to the insertion hole 27*a*. The gap body 27 is arranged on the upper surface of the axle box 17 by inserting the insertion pin 17*a* into the insertion hole 27*a*. The gap body 27 is positioned with respect to the axle box 17 by the insertion pin 17*a*. Further, an insertion hole 27*b* is formed at a middle of an upper surface of the gap body 27, and an insertion pin 29*a* is formed on the lower surface of the support base 29 at a position corresponding to the insertion hole 27*b*. The support base 29 is arranged on the upper surface of the gap body 27 by inserting the insertion pin 29*a* into the insertion hole 27*b*. The support base 29 is positioned with respect to the gap body 27 by the insertion pin 29*a*. As above, the support base 29 is arranged at the axle box 17 through the gap body 27. By the elastic deformation (specifically, the shearing deformation) of the gap body 27, the support base 29 is displaced relative to the axle box 17 in the horizontal direction. The receiving member 30 on which an end portion of a plate spring 34 is placed is provided on the upper surface of the support base 29.

Figure 2:
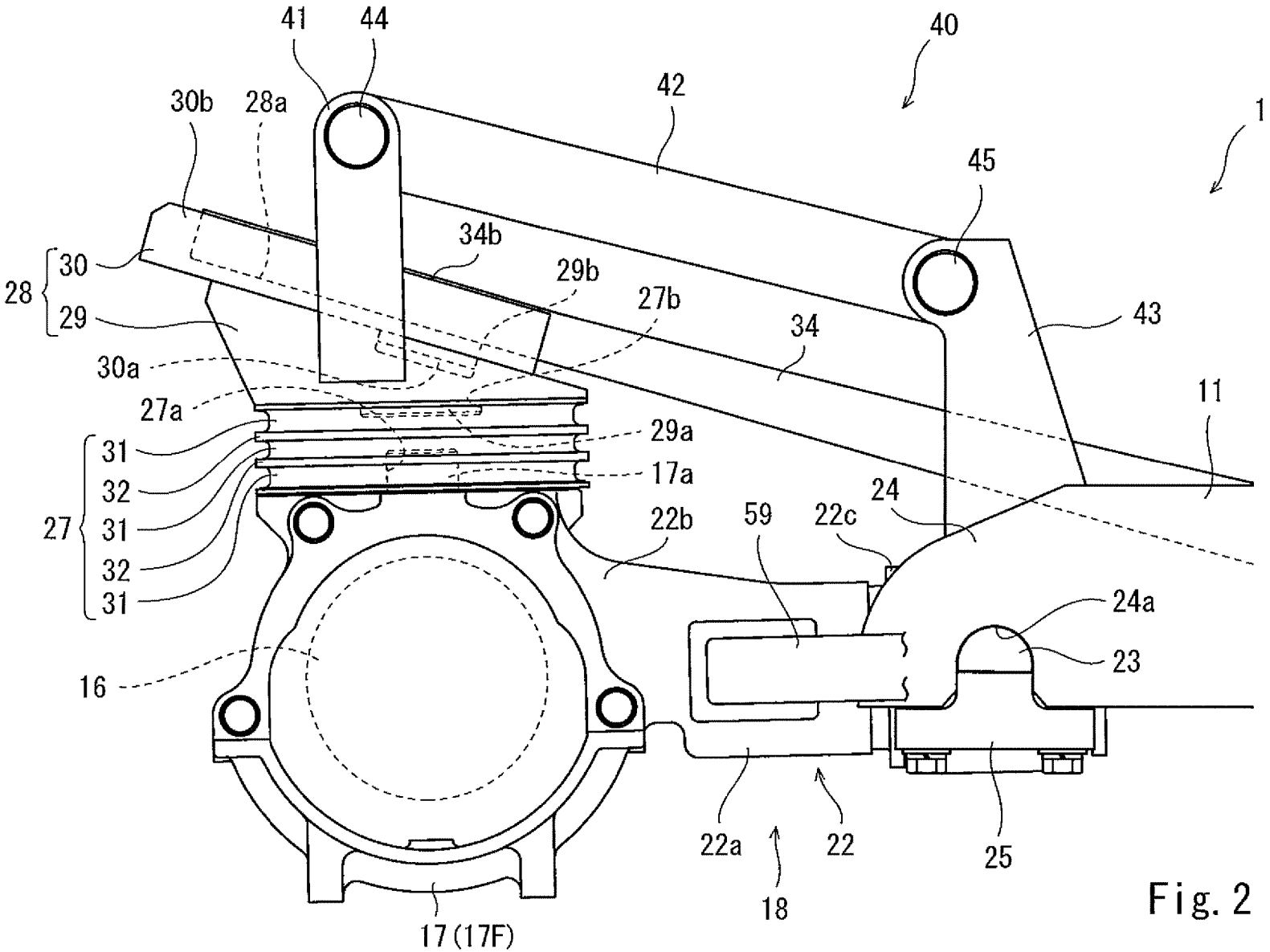
FIG. 2 is an enlarged side view showing the vicinity of an axle box shown in FIG. 1.
Figure 3:
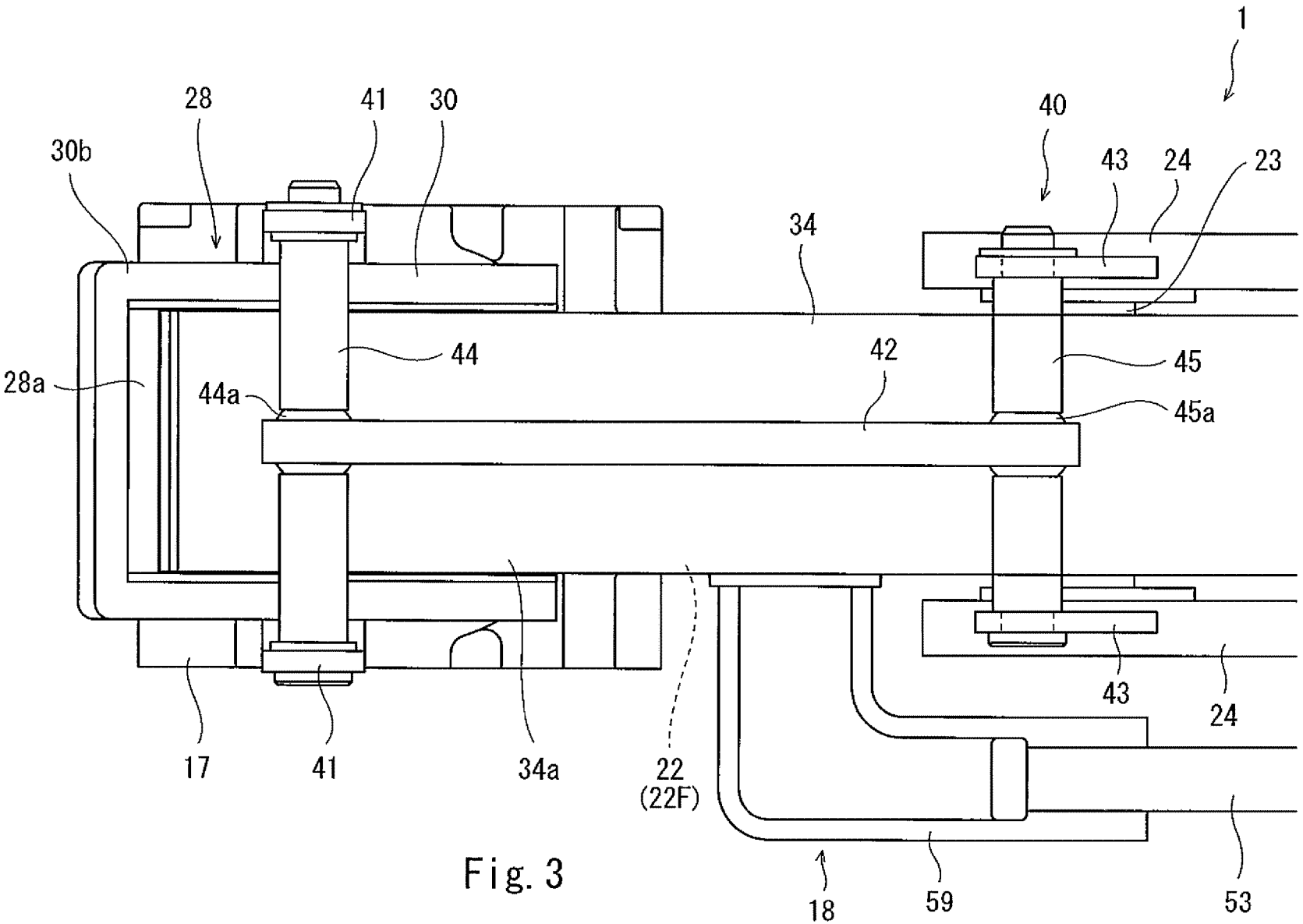
FIG. 3 is a plan view when viewing the vicinity of the axle box shown in FIG. 2 from above.

The receiving member 30 is made of metal or resin, and as shown in FIG. 3, is formed in a rectangular shape in a plan view. Further, as shown in FIG. 2, an insertion pin 30*a* is formed on a lower surface of the receiving member 30, and an insertion hole 29*b* is formed on the upper surface of the support base 29 at a position corresponding to the insertion pin 30*a*. The receiving member 30 is arranged on the upper surface of the support base 29 by inserting the insertion pin 30*a* into the insertion hole 29*b*. The receiving member 30 is positioned with respect to the upper surface of the support base 29 by the insertion pin 30*a*. An outer frame 30*b* having a U shape in a plan view is formed on an upper surface of the receiving member 30 so as to surround an outer peripheral edge portion of the upper surface of the receiving member 30 from both sides in the car width direction and an outer side in the car longitudinal direction. A surface located at an inner side of the outer frame 30*b* in a plan view forms a seat surface 28*a* of the support seat 28. The support seats 28 are arranged above the respective axle boxes 17 arranged at the front and rear sides. The seat surfaces 28*a* of the two support seats 28 are arranged so as to face each other, and the plate spring 34 extends between the seat surfaces 28*a* of the two support seats 28.

As shown in FIG. 1, the plate spring 34 extends in the car longitudinal direction and has a bow shape that is convex downward. The plate spring 34 has both the function of a primary suspension and the function of a conventional side sill. A car longitudinal direction middle portion 34*a* of the plate spring 34 is arranged under a car width direction end portion 21*a* of the cross beam 21. A contact member 35 having a substantially circular-arc shape is formed on a lower surface of the car width direction end portion 21*a* of the cross beam 21. The contact member 35 is placed on but is not fixed to the car longitudinal direction middle portion 34*a* of the plate spring 34.

The plate spring 34 extends in an obliquely upward direction from the car longitudinal direction middle portion 34*a* to each of both car longitudinal direction ends thereof. Both car longitudinal direction end portions 34*b* of the plate spring 34 reach respective upper sides of the axle boxes 17. Each of both car longitudinal direction end portions 34*b* of the plate spring 34 extends in the obliquely upward direction along the inclination of an upper surface of the support seat 28, i.e., along the inclination of the seat surface 28*a* and is placed on but is not fixed to the seat surface 28*a*. As above, both car longitudinal direction end portions 34*b* of the plate spring 34 are supported by the support seats 28 at upper sides of the front and rear axle boxes 17, and the car longitudinal direction middle portion 34*a* of the plate spring 34 is arranged under but is not fixed to the cross beam 21.

According to the bogie 1 configured as above, when vehicle occupancy increases, and a downward load of the carbody 4 increases, the downward load acts on the car longitudinal direction middle portion 34*a* of the plate spring 34 through the cross beam 21 and the contact member 35, and the car longitudinal direction middle portion 34*a* of the plate spring 34 sinks downward. In accordance with this, contact positions at each of which the car longitudinal direction end portion 34*b* of the plate spring 34 and the receiving member 30 contact each other move close to the car longitudinal direction middle portion 34*a* (cross beam 21). To be specific, the car longitudinal direction end portions 34*b* and car longitudinal direction middle portion 34*a* of the plate spring 34 are not fixed, so that when a height difference between front and rear wheels is generated by, for example, irregularities of a railway track, the plate spring 34 rotates about the contact member 35 like a seesaw to absorb the height difference, and this prevents a decrease of a wheel load.

The bogie 1 configured as above is a steering bogie with a bolster and includes a bolster beam 46. The bolster beam 46 is provided at the cross beam 21 through a support shaft 47 and turns relative to the cross beam 21 about a vertical axis L0. The bolster beam 46 supports the carbody 4 through the air spring 5 and is coupled to the carbody 4 by a bolster anchor 48. Therefore, the bolster beam 46 swings integrally with the carbody 4. Further, the bogie 1 includes a pair of steering mechanisms 50 for steering the pair of wheelsets 12 (for causing the pair of wheelsets 12 to turn in a yawing direction) in accordance with the swing operation of the bolster beam 46.

Steering Mechanism

The pair of steering mechanisms 50 (one of which is not shown) are arranged at both respective car width direction side-surface portions of the bogie frame 11. The steering mechanisms 50 are arranged mirror-symmetrically about a center line of the carbody 4. The steering mechanisms 50 are the same in configuration as each other. Each of the steering mechanisms 50 includes a coupling link 51, a steering lever 52, a first steering link 53, and a second steering link 54. The coupling link 51 is a member extending in a substantially car longitudinal direction. One car longitudinal direction end portion of the coupling link 51 is coupled to the bolster beam 46 through a bolster beam-side link receiving member 55. The coupling link 51 moves in the car longitudinal direction in conjunction with relative swing operations of the bolster beam 46 and the cross beam 21. Further, the car longitudinal direction end portion of the coupling link 51 is attached to the bolster beam-side link receiving member 55 so as to be relatively turnable in the car upward/downward direction. The other car longitudinal direction end portion of the coupling link 51 is coupled to the steering lever 52.

The steering lever 52 extends in the car upward/downward direction, and the coupling link 51 is attached to one upward/downward direction end portion of the steering lever 52 so as to be turnable. Further, the steering lever 52 is attached to the side-surface portion of the bogie frame 11 through a pin member 56. The pin member 56 extends in the car width direction, and the steering lever 52 is turnable about a fulcrum axis L3 that is an axis of the pin member 56. Further, two pin members 57 and 58 are provided at the steering lever 52. The pin members 57 and 58 sandwich the first pin member 56 and are spaced apart from the pin member 56 in the upward/downward direction at regular intervals. The first steering link 53 is provided at the steering lever 52 through the pin member 57, and the second steering link 54 is provided at the steering lever 52 through the pin member 58.

Each of the first steering link 53 and the second steering link 54 is a member extending in the car longitudinal direction. One car longitudinal direction end portion of the first steering link 53 is attached to the steering lever 52 through the pin member 57, and one car longitudinal direction end portion of the second steering link 54 is attached to the steering lever 52 through the pin member 58. With this, the first steering link 53 is attached to the steering lever 52 so as to be turnable about the pin member 57, and the second steering link 54 is attached to the steering lever 52 so as to be turnable about the pin member 58. The other car longitudinal direction end portion of the first steering link 53 is coupled through a first axle beam-side link receiving member 59 to an axle beam 22F located at one side in the car longitudinal direction, and the other car longitudinal direction end portion of the second steering link 54 is coupled through a second axle beam-side link receiving member 60 to an axle beam 22B located at the other side in the car longitudinal direction.

When the bolster beam 46 and the cross beam 21 relatively swing while the bogie 1 is traveling through a curved section, the steering mechanism 50 operates in conjunction with the swing operations of the bolster beam 46 and the cross beam 21. To be specific, when the bolster beam 46 and the cross beam 21 relatively swing, the coupling link 51 moves toward one side (or the other side) in the car longitudinal direction in conjunction with the swing operations. With this, the steering lever 52 turns in a clockwise direction (or a counterclockwise direction) about the fulcrum axis L3. Thus, the pin members 57 and 58 also turn in the clockwise direction (or the counterclockwise direction) about the fulcrum axis L3 integrally with the steering lever 52. By this turning operation, the first steering link 53 and the second steering link 54 move in different directions along the longitudinal direction. With this, the pair of front and rear axle beams 22F and 22B can move close to each other or move away from each other in accordance with the swing operations.

In the bogie 1, the pair of steering mechanisms 50 are arranged mirror-symmetrically, so that at the time of the swing operations, the coupling links 51 of the steering mechanisms 50 move in respective directions opposite to each other. Therefore, a pair of front and rear axle beams 22F and 22B located near an inner rail of the curved section, i.e., a pair of front and rear axle boxes 17F and 17B located near the inner rail of the curved section move close to each other, and a pair of front and rear axle beams 22F and 22B located near an outer rail of the curved section, i.e., a pair of front and rear axle boxes 17F and 17B located near the outer rail of the curved section move away from each other. With this, attack angles of the pair of front and rear wheelsets 12 can be reduced. As above, the steering mechanisms 50 can steer the pair of wheelsets 12 in accordance with the curved shape of the rail 3 and can cause the bogie 1 to smoothly travel through the curved section.

Figure 5:
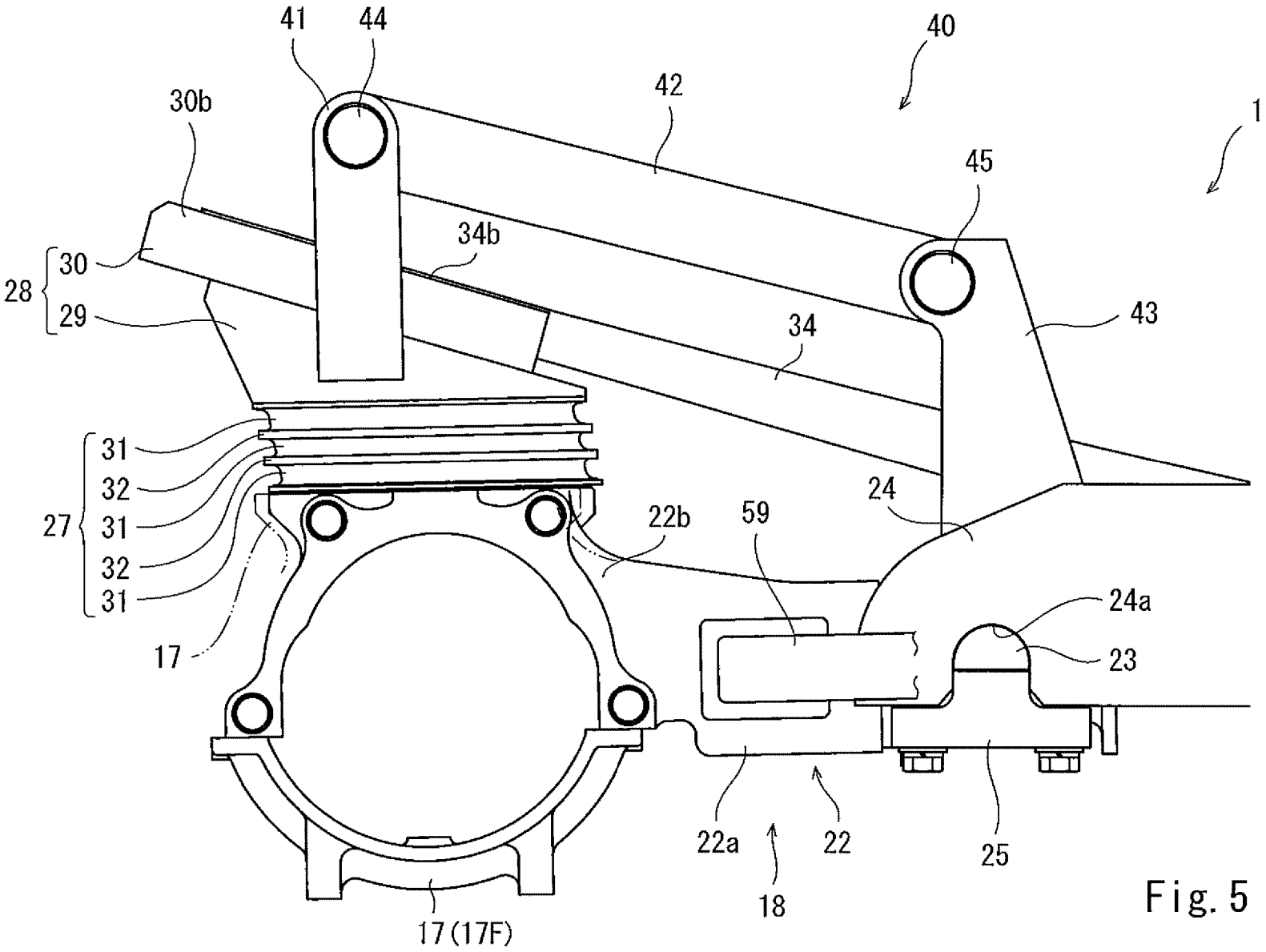
FIG. 5 is an enlarged side view showing a state where the axle box is relatively displaced so as to move close to the bogie frame.

As above, in the bogie 1, the pair of wheelsets 12 are steered in the curved section by displacing the front and rear axle boxes 17F and 17B relative to the bogie frame. As shown in FIG. 5, the pair of front and rear axle boxes 17F and 17B located near the inner rail move toward the receiving seats 24 of the bogie frame 11 (see the axle box 17F (before displacement) shown by two-dot chain lines in FIG. 5). On the other hand, a constant interval is kept between the bogie frame 11 and each of the support seats 28 arranged on the respective axle boxes 17F and 17B to suppress a relative displacement magnitude between the support seat 28 and the car longitudinal direction end portion 34*b* of the plate spring 34. Therefore, although the axle box (17F, 17B) and the support seat 28 provided thereon are relatively displaced during steering, the relative displacement of the axle box (17F, 17B) and the support seat 28 is allowed by interposing the gap body 27 between the axle box (17F, 17B) and the support seat 28, the gap body 27 being capable of performing shearing elastic deformation. With this, even when the pair of front and rear axle boxes 17F and 17B move toward the receiving seats 24, the support seats 28 each supporting the car longitudinal direction end portion 34*b* of plate spring 34 can be prevented from moving in conjunction with the axle boxes 17F and 17B. Therefore, even when the axle boxes 17F and 17B move toward the bogie frame 11, a horizontal component of a carbody support load acting on the axle boxes 17F and 17B can be prevented from increasing. On this account, it is possible to prevent a case where during steering, the axle boxes 17F and 17B are inhibited by the carbody support load from moving close to each other. Thus, the deterioration of steering performance of the bogie 1 can be suppressed.

The pair of front and rear axle boxes 17F and 17B located near the outer rail move away from the receiving seats 24 of the bogie frame 11. On the other hand, a constant interval is kept between the bogie frame 11 and each of the support seats 28 arranged on the respective axle boxes 17F and 17B to suppress a relative displacement magnitude between the support seat 28 and the car longitudinal direction end portion 34*b* of the plate spring 34. Therefore, although the axle box (17F, 17B) and the support seat 28 provided thereon are relatively displaced during steering, the relative displacement of the axle box (17F, 17B) and the support seat 28 is allowed by interposing the gap body 27 between the axle box (17F, 17B) and the support seat 28, the gap body 27 being capable of performing shearing elastic deformation. With this, even when the pair of front and rear axle boxes 17F and 17B move away from the receiving seats 24, the support seats 28 each supporting the car longitudinal direction end portion 34*b* of plate spring 34 can be prevented from moving in conjunction with the axle boxes 17F and 17B. Therefore, even when the axle boxes 17F and 17B move away from the bogie frame 11, the horizontal component of the carbody support load acting on the axle boxes 17F and 17B can be prevented from increasing.

As above, at each of the inner rail side and the outer rail side in the bogie 1, the constant interval between the support seat 28 and the bogie frame 11 is kept by the gap body 27 even during steering, and the increase in the horizontal component of the carbody support load acting on the axle boxes 17F and 17B is suppressed. Thus, the movement of a steering axle when passing through the curved line is not inhibited. Further, since the support seats 28 can be prevented from moving in conjunction with the axle boxes 17F and 17B, the relative displacement magnitude between the seat surface 28*a* of the support seat 28 and the car longitudinal direction end portion 34*b* of the plate spring 34 can be suppressed. Therefore, it is possible to prevent a case where the seat surface 28*a* of the support seat 28 and the car longitudinal direction end portion 34*b* of the plate spring 34 slide on each other to be worn away. To prevent the support seat 28 and the plate spring 34 from being worn away, the bogie 1 further includes interlock mechanisms 40. Each of the interlock mechanisms 40 extends between the support seat 28 and the bogie frame 11.

As shown in FIGS. 2 and 3, the interlock mechanism 40 includes a pair of support seat-side brackets 41, a link member 42, and a pair of bogie frame-side brackets 43. The pair of support seat-side brackets 41 are plate-shaped members extending in the car upward/downward direction and are arranged at both respective car width direction sides of the support base 29. Lower end portions of the support seat-side brackets 41 are bent toward the support base 29 and fixed to side-surface portions of the support base 29, and a support seat-side shaft member 44 extends between upper end portions of the support seat-side brackets 41. The support seat-side shaft member 44 includes a spherical bushing 44*a* at an axial direction middle portion thereof, and the link member 42 is attached to the spherical bushing 44*a*. The link member 42 is a plate-shaped member connecting the support seat 28 and the bogie frame 11 and extending in the car longitudinal direction. One end portion of the link member 42 is attached to the spherical bushing 44*a* so as to be swivelable about a center of the spherical bushing 44*a*. To be specific, the link member 42 can pivot in the car upward/downward direction about an axis L1 of the support seat-side shaft member 44 and can also pivot in the car width direction by the spherical bushing 44*a*. The other end portion of the link member 42 configured as above is attached to the pair of bogie frame-side brackets 43 through a bogie frame-side shaft member 45.

The pair of bogie frame-side brackets 43 are plate-shaped members extending in the car upward/downward direction and are provided at the bogie frame 11 so as to be spaced apart from each other in the car width direction. Specifically, the bogie frame-side brackets 43 stand on respective upper surfaces of the pair of receiving seats 24. Further, the bogie frame-side shaft member 45 extends between upper end portions of the pair of bogie frame-side brackets 43. The bogie frame-side shaft member 45 includes a spherical bushing 45*a* at an axial direction middle portion thereof. The other end portion of the link member 42 is attached to the spherical bushing 45*a* of the bogie frame-side shaft member 45 so as to be swivelable about a center of the spherical bushing 45*a*. To be specific, the link member 42 can pivot relative to the bogie frame-side shaft member 45 in the car upward/downward direction about an axis L2 of the bogie frame-side shaft member 45 and can also pivot in the car width direction by the spherical bushing 45*a*.

Figure 4:
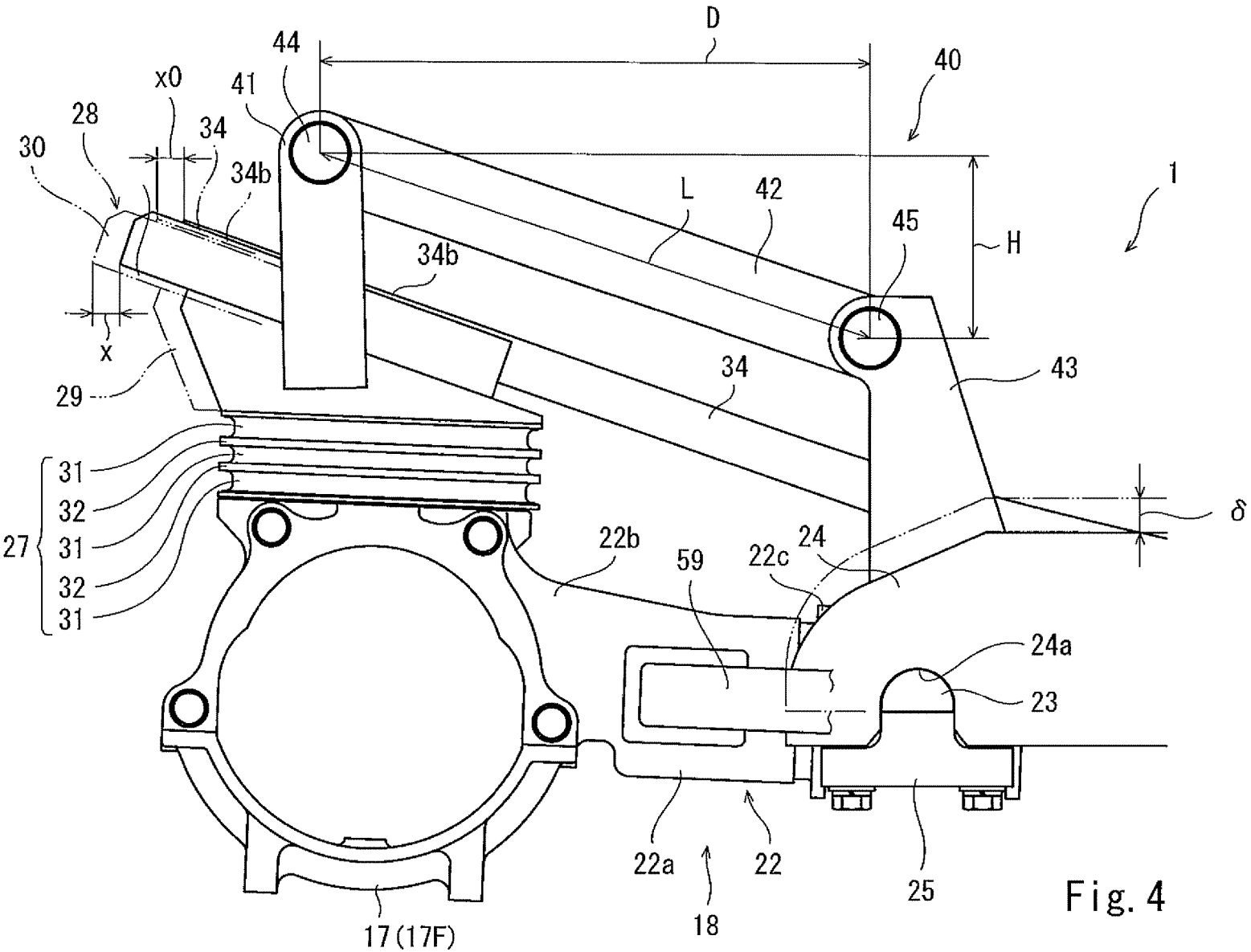
FIG. 4 is an enlarged side view showing a state where a bogie frame sinks.

According to the interlock mechanism 40 configured as above, when the cross beam 21 sinks downward by the increase in the downward load of the carbody 4, and in accordance with this, the pair of receiving seats 24 sink downward (also see the receiving seat 24 (before sinking) shown by a two-dot chain line in FIG. 4), the pair of bogie frame-side brackets 43 move downward. With this, the link member 42 pivots upward about the axis L2 of the bogie frame-side shaft member 45 to displace the support seat-side brackets 41 inward in the car longitudinal direction. The support seat 28 to which the support seat-side brackets 41 are coupled is allowed to be displaced relative to the axle box 17 in the car longitudinal direction by the gap body 27. Therefore, the link member 42 can displace the support seat 28 inward in the car longitudinal direction, i.e., can move the support seat 28 toward the cross beam 21 through the support seat-side brackets 41 (see the support seat 28 (before sinking) shown by a two-dot chain line in FIG. 4). With this, when the cross beam 21 and the car longitudinal direction middle portion 34*a* of the plate spring 34 sink downward by the downward load, the support seats 28 can be relatively displaced inward in the car longitudinal direction in accordance with the movements of both car longitudinal direction end portions 34*b* of the plate spring 34. Thus, a relative sliding displacement magnitude between the car longitudinal direction end portion 34*b* of the plate spring 34 and the support seat 28 when the cross beam 21 sinks can be suppressed.

As above, the interlock mechanism 40 causes the car longitudinal direction end portion 34*b* of the plate spring 34 and the support seat 28 to move in conjunction with each other, and with this, the relative sliding displacement magnitude between the car longitudinal direction end portion 34*b* of the plate spring 34 and the support seat 28 can be suppressed. Further, to prevent, by reducing the relative sliding displacement magnitude, the support seat 28 and the plate spring 34 from being worn away, it is preferable to configure the interlock mechanism 40 as below. To be specific, according to the interlock mechanism 40, a displacement magnitude x of the support seat in the car longitudinal direction is represented by Formulas (1) and (2) below, where: D denotes a car longitudinal direction distance between the axes L1 and L2; H denotes a car upward/downward direction distance between the axes L1 and L2; δ denotes a downward deflection amount of the car longitudinal direction middle portion 34*a* of the plate spring 34 (i.e., a sink amount of the bogie frame 11); and L denotes a length of the link member 42.

$$x=D-L\cos\theta \tag{1}$$

$$\theta=\sin^{-1}((H+\delta)/L) \tag{2}$$

The car longitudinal direction distance D, the car upward/downward direction distance H, and the length L of the link member in the interlock mechanism 40 are set such that an absolute value $|x-x_0|$ of a difference between a displacement magnitude $x_0$ of the car longitudinal direction end portion 34*b* in the car longitudinal direction with respect to the deflection amount δ of the car longitudinal direction middle portion 34*a* of the plate spring 34 and the displacement magnitude x of the support seat in the car longitudinal direction with respect to the deflection amount δ becomes 5 mm or less.

It should be noted that the displacement magnitude $x_0$ of the car longitudinal direction end portion 34*b* of the plate spring 34 in the car longitudinal direction with respect to the deflection amount δ is a value acquired by simulation or an experiment. For example, the deflection amount δ of the car longitudinal direction middle portion 34*a* of the plate spring 34 is changed by simulation or an experiment in a range from a minimum value (for example, a deflection amount when the railcar is empty) to a maximum value (for example, a deflection amount when the railcar is full), and various values of the displacement magnitude $x_0$ of the car longitudinal direction end portion 34*b* of the plate spring 34 in the car longitudinal direction with respect to the changed deflection amounts δ are acquired. Then, the car longitudinal direction distance D, the car upward/downward direction distance H, and the length L of the link member are determined such that the absolute value $|x-x_0|$ of the difference between the displacement magnitude $x_0$ and the displacement magnitude x with respect to each of all of the deflection amounts δ does not exceed 5 mm.

When the cross beam 21 and the car longitudinal direction middle portion 34*a* of the plate spring 34 sink downward by the downward load, the interlock mechanism 40 configured as above can displace the car longitudinal direction end portions 34*b* and the support seats 28 together to suppress the relative sliding displacement magnitude to 5 mm or less. With this, the car longitudinal direction end portions 34*b* and the seat surfaces 28*a* of the support seats 28 can be prevented from being worn away. Thus, the life of the plate spring 34 can be improved.

As described above, when the height difference between the front and rear wheels is generated, the plate spring 34 can move about the contact member 35 as a fulcrum like a seesaw to absorb the change in the wheel load. Even when the plate spring 34 moves like this, the interlock mechanism 40 can suppress the relative displacement magnitude between the seat surface 28*a* of the support seat 28 and the car longitudinal direction end portion 34*b* of the plate spring 34. Thus, the interlock mechanism 40 can prevent a case where the seat surface 28*a* of the support seat 28 and the car longitudinal direction end portion 34*b* of the plate spring 34 slide on each other to be worn away.

In the bogie 1, both car longitudinal direction end portions of the link member 42 of interlock mechanism 40 are attached to the respective spherical bushings 44*a* and 45*a* so as to be swivelable, and with this, relative displacement of the seat surface 28*a* and the bogie frame 11 in the car width direction is allowed. With this, even when the axle boxes 17F and 17B and the bogie frame 11 are relatively displaced in the car width direction during steering, an excessive load in the car width direction can be prevented from acting on the link member 42. Further, in the bogie 1, the seat surfaces 28*a* of the support seats 28 are inclined. Therefore, without bending both longitudinal direction end portions 34*b* of the plate spring 34, both longitudinal direction end portions 34*b* extending linearly can be supported by the respective support seats 28. On this account, the deterioration of the strength of the plate spring 34 can be suppressed.

Embodiment 2

A steering bogie 1A of Embodiment 2 is similar in configuration to the steering bogie 1 of Embodiment 1 but is different from the steering bogie 1 of Embodiment 1 in that the length and inclination of the link are finely adjustable. Hereinafter, components of the steering bogie 1A of Embodiment 2 which are different from the components of the steering bogie 1 of Embodiment 1 will be mainly explained. The same reference signs are used for the same components, and a repetition of the same explanation is avoided.

Figure 6:
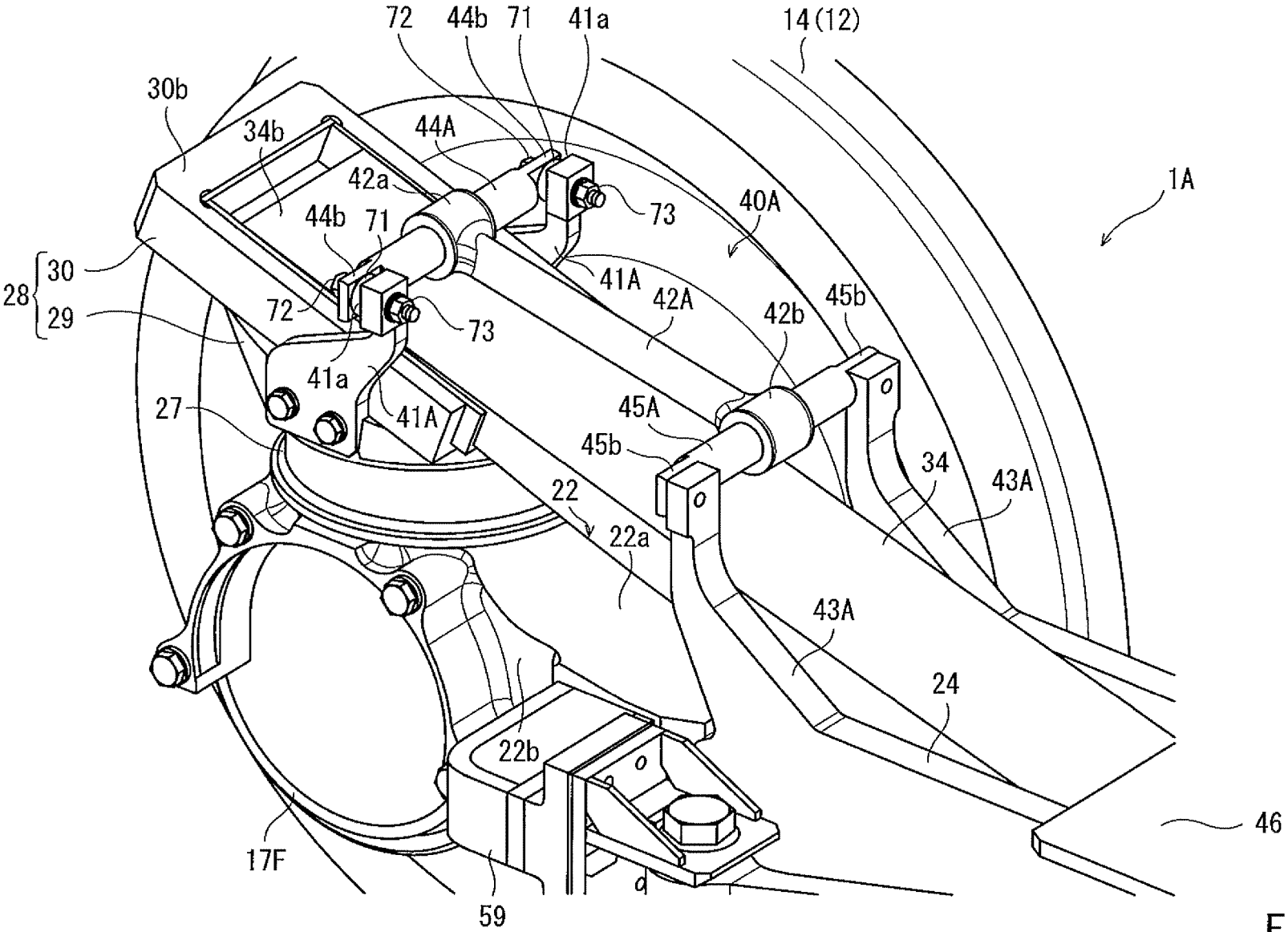
FIG. 6 is an enlarged perspective view showing the vicinity of the axle box of the railcar steering bogie according to Embodiment 2.
Figure 7:
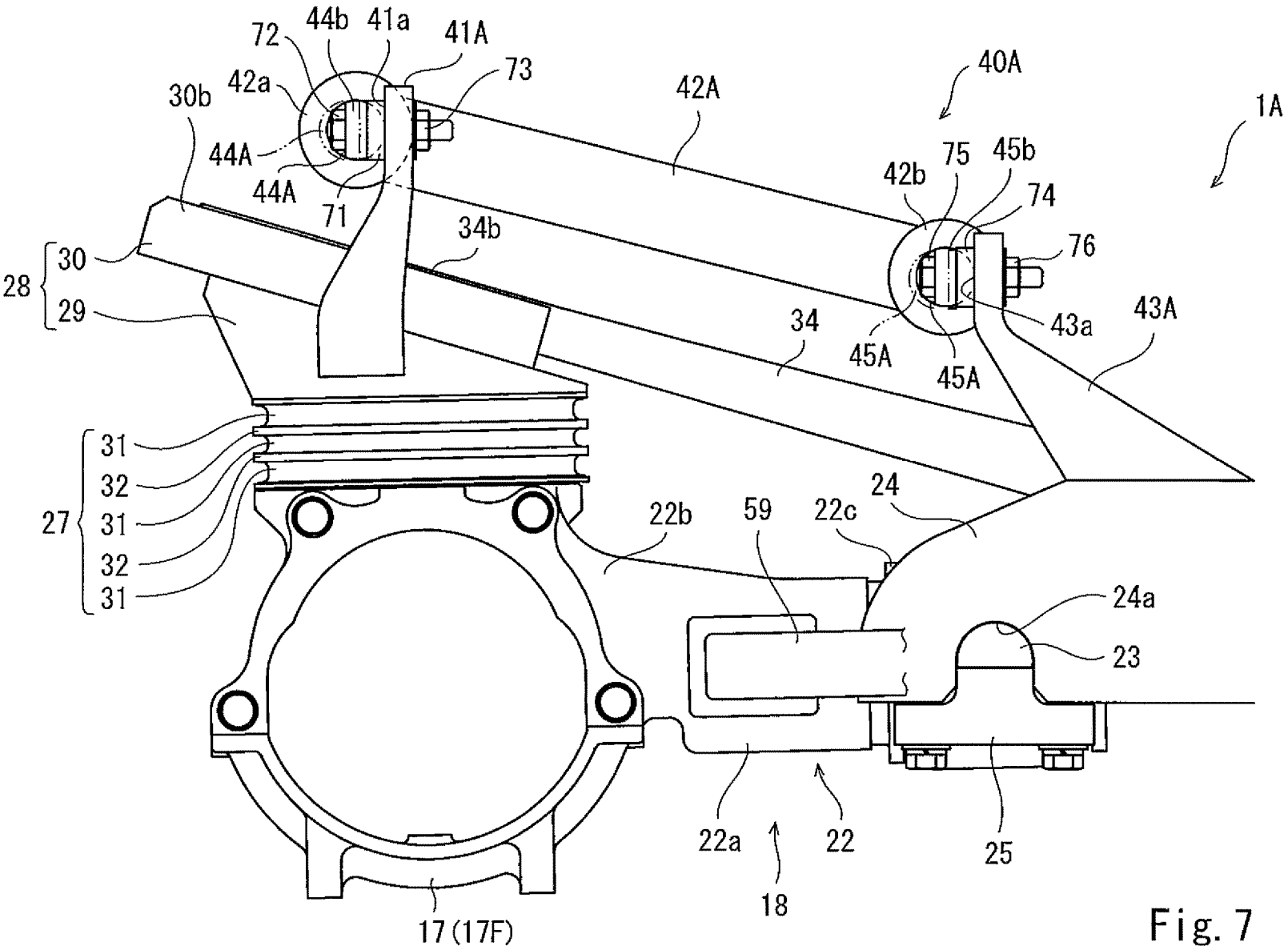
FIG. 7 is an enlarged side view showing the vicinity of the axle box of the railcar steering bogie shown in FIG. 6.

As shown in FIGS. 6 and 7, an interlock mechanism 40A includes a pair of support seat-side brackets 41A, a link member 42A, and a pair of bogie frame-side brackets 43A. The pair of support seat-side brackets 41A are arranged at both respective car width direction sides of the support base 29, and lower end portions of the support seat-side brackets 41A are fixed to respective side-surface portions of the support base 29. Each of the support seat-side brackets 41A includes a shaft member attaching surface 41*a* at an upper end portion thereof. The shaft member attaching surface 41*a* is a flat surface extending in the car upward/downward direction and facing toward a car outside. A support seat-side shaft member 44A is attached to the shaft member attaching surfaces 41*a* through adjustment plates 71. Each of the adjustment plates 71 is a ring-shaped member, and both thickness direction-side surfaces (i.e., both car longitudinal direction-side surfaces) of the adjustment plate 71 are formed flat. The adjustment plate 71 is arranged on the shaft member attaching surface 41*a* by bringing one thickness direction-side surface thereof into contact with the shaft member attaching surface 41*a*. Further, the other thickness direction-side surface of the adjustment plate 71 is brought into contact with an end portion 44*b* of the support seat-side shaft member 44A. Each of both end portions 44*b* of the support seat-side shaft member 44A is formed in a flat plate shape and is arranged by bringing one surface thereof (i.e., one car longitudinal direction-side surface thereof) into contact with the other thickness direction-side surface of the adjustment plate 71. Further, bolts 72 are inserted into both respective end portions 44*b* of the support seat-side shaft member 44A from the other thickness direction-side surfaces (i.e., the other car longitudinal direction-side surfaces) of the end portions 44*b*. Each of the bolts 72 penetrates through the adjustment plate 71 and an upper end portion of the support seat-side bracket 41A, and a nut 73 is threadedly engaged with a tip end portion of the bolt 72. With this, the end portions 44*b* of the support seat-side shaft member 44A are attached to the support seat-side brackets 41A through the adjustment plates 71, and the link member 42A is attached to an axial direction middle portion of the support seat-side shaft member 44A.

The link member 42A is a columnar member and includes cylindrical insertion portions 42*a* and 42*b* at both respective axial direction end portions thereof. Each of the insertion portions 42*a* and 42*b* includes an inner hole extending in the car width direction. The support seat-side shaft member 44A is inserted into the insertion portion 42*a*, and a bogie frame-side shaft member 45A is inserted into the insertion portion 42*b*. One end portion of the link member 42A configured as above is attached to the pair of support seat-side brackets 41A through the support seat-side shaft member 44A, and the other end portion of the link member 42A is attached to the pair of bogie frame-side brackets 43A through the bogie frame-side shaft member 45A.

The pair of bogie frame-side brackets 43A are provided at the bogie frame 11 so as to be spaced apart from each other in the car width direction, and lower end portions of the bogie frame-side brackets 43A stand on the respective upper surfaces of the pair of receiving seats 24. Each of the bogie frame-side brackets 43A includes a shaft member attaching surface 43*a* at an upper end portion thereof. The shaft member attaching surface 43*a* is a flat surface extending in the car upward/downward direction and facing toward the car outside. The bogie frame-side shaft member 45A is attached to the shaft member attaching surfaces 43*a* through adjustment plates 74. It should be noted that since FIG. 6 does not show the adjustment plate 74 and the like explained below as a matter of convenience in the drawing, the following explanation is made in reference to FIG. 7. As with the adjustment plate 71, each of the adjustment plates 74 is a ring-shaped member, and both thickness direction-side surfaces (i.e., both car longitudinal direction-side surfaces) of the adjustment plate 74 are formed flat. The adjustment plate 74 is arranged on the shaft member attaching surface 43*a* by bringing one thickness direction-side surface thereof into contact with the shaft member attaching surface 43*a*. Further, the other thickness direction-side surface of the adjustment plate 74 is brought into contact with an end portion 45*b* of the bogie frame-side shaft member 45A. Each of both end portions 45*b* of the bogie frame-side shaft member 45A is formed in a flat plate shape as with both end portions 44*b* of the support seat-side shaft member 44A and is arranged by bringing one surface thereof (i.e., one car longitudinal direction-side surface thereof) into contact with the other thickness direction-side surface of the adjustment plate 74. Further, bolts 75 are inserted into both respective end portions 45*b* of the bogie frame-side shaft member 45A from the other thickness direction-side surfaces (i.e., the other car longitudinal direction-side surfaces) of the end portions 45*b*. Each of the bolts 75 penetrates through the adjustment plate 74 and an upper end portion of the bogie frame-side bracket 43A, and a nut 76 is threadedly engaged with a tip end portion of the bolt 75. With this, the end portions 45*b* of the bogie frame-side shaft member 45A are attached to the bogie frame-side brackets 43A through the adjustment plates 74, and thus, the interlock mechanism 40A extends between the support seat 28 and the bogie frame 11.

As the adjustment plates 71 and 74, a plurality of adjustment plates of different thicknesses are prepared. Therefore, the length L of the link member 42 can be adjusted. To be specific, each of the adjustment plates 71 of different thicknesses can be arranged between the support seat-side shaft member 44A and the support seat-side bracket 41A, and each of the adjustment plates 74 of different thicknesses can be interposed between the bogie frame-side shaft member 45A and the bogie frame-side bracket 43A. By changing the thicknesses of the adjustment plates 71 and 74 interposed as above, the positions of the shaft members 44A and 45A in the car longitudinal direction can be changed (see two-dot chain lines in FIG. 6). For example, in the bogie 1A, when the length L of the link member 42A is changed for finely adjusting the displacement magnitude x of the interlock mechanism 40A, the positions of the end portions of the link member 42A also change. Therefore, at least one of the positions of the support seat-side shaft member 44A and the bogie frame-side shaft member 45A in the car longitudinal direction needs to be changed. On this account, by changing the thicknesses of the adjustment plates 71 or 74, at least one of the positions of the support seat-side shaft member 44A and the bogie frame-side shaft member 45A in the car longitudinal direction can be changed. This facilitates a replacing operation of replacing the link member 42A with the link member 42A of a different length for finely adjusting the displacement magnitude x of the interlock mechanism 40A. Therefore, an operation of finely adjusting the relative sliding displacement magnitude between the plate spring 34 and the support seat 28 can be facilitated.

Other than the above, the bogie 1A of Embodiment 2 has the same operational advantages as the bogie 1 of Embodiment 1.

Other Embodiments

In each of the bogies 1 and 1A of Embodiments 1 and 2, both car longitudinal direction end portions of the link member 42 of the interlock mechanism 40A are attached to the pair of brackets 41 and the pair of brackets 43 through the shaft members 44 and 45 so as to be turnable. However, the link member 42 does not necessarily have to be turnable with respect to both the pair of brackets 41 and the pair of brackets 43 and is only required to be configured to be turnable with respect to at least one of the pair of brackets 41 and the pair of brackets 43. Further, the link member 42 is arranged along a center line of the plate spring 34 but does not necessarily have to be arranged in this manner. For example, the link member 42 may be arranged away from the center line of the plate spring 34. Or, a pair of link members 42 may be used and may be arranged on car width direction outer surfaces of the brackets 41 and 43 so as to be turnable.

Figure 8:
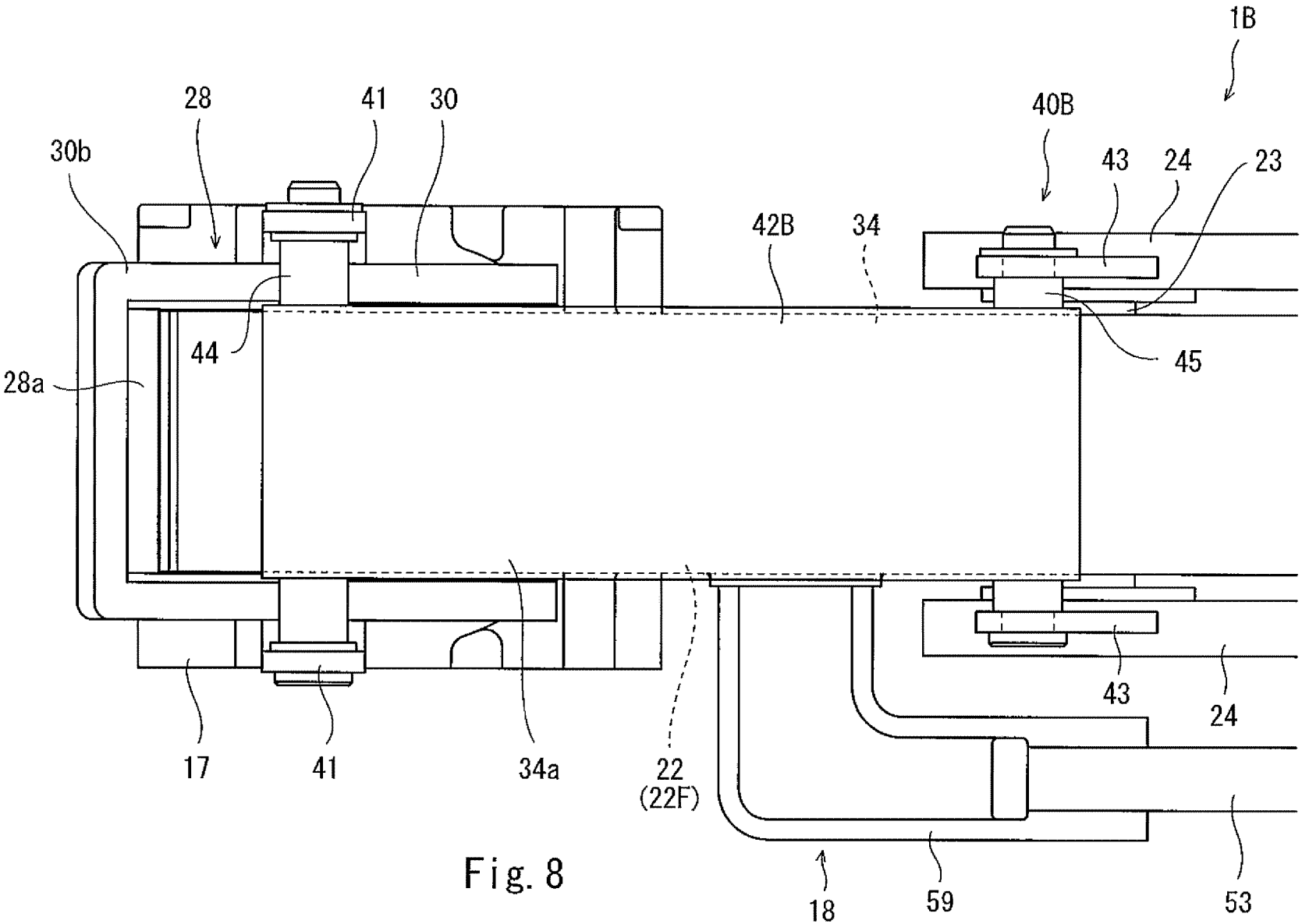
FIG. 8 is a plan view showing the railcar steering bogie according to Other Embodiment.

Further, the link member 42 is arranged above the plate spring 34, and the length of the link member 42 in the car width direction (i.e., the thickness of the link member 42) is smaller than the width of the plate spring 34. However, the link member 42 does not necessarily have to have such shape. For example, as shown in FIG. 8, a link member 42B of an interlock mechanism 40B may be a flat plate formed such that a length thereof in the car width direction (i.e., the width of the link member 42B) is larger than a length thereof in the car upward/downward direction (i.e., the thickness of the link member 42B), and the link member 42B may be arranged so as to partially overlap the plate spring 34 in a plan view. In this case, it is preferable that the width of the link member 42B be equal to or more than the width of the plate spring 34. By arranging the link member 42B having such shape above the plate spring 34, the plate spring 34 can be protected from flying objects, such as small stones thrown up by a wheel during traveling.

Further, in each of the bogies 1 and 1A of Embodiments 1 and 2, the axle beam 22 is adopted as the coupling member coupling the axle box 17 and the bogie frame 11. However, the coupling member does not necessarily have to be the axle beam 22. For example, the coupling member may be a link as in a mono-link type bogie.

Further, in each of the bogies 1 and 1A of Embodiments 1 and 2, the multi-layer rubber is adopted as the gap body 27. However, the gap body 27 is not limited to the multi-layer rubber and is only required to be a member capable of performing elastic deformation. Further, the gap body 27 does not necessarily have to be the member capable of performing the elastic deformation and is only required to be configured to allow relative displacement of the support seat 28 and the axle box 17. For example, the gap body may be constituted by a self-lubrication rubber member. In this case, the gap body made of self-lubrication rubber is fixed to any one of the support seat 28 and the axle box 17, and the support seat 28 is configured to slide on the upper surface of the axle box 17. With this, the relative displacement of the support seat 28 and the axle box 17 can be allowed, and as with the bogies 1 and 1A of Embodiments 1 and 2, the increase in the horizontal component of the carbody support load during steering can be suppressed.

Further, each of the bogies 1 and 1A of Embodiments 1 and 2 includes the steering mechanisms 50 but does not necessarily have to include the steering mechanisms 50. Further, the steering mechanism 50 is configured to move the pair of front and rear axle boxes 17F and 17B but may be configured to move at least one of the front and rear axle boxes 17F and 17B. Further, each of the bogies 1 and 1A of Embodiments 1 and 2 is a bogie with a bolster but does not necessarily have to include the bolster beam 46. To be specific, each of the bogies 1 and 1A may be a bolsterless bogie. In this case, the coupling link 51 is turnably coupled to a link receiving member projecting downward from a lower surface of the carbody 4. With this, the wheelsets 12 can be steered in conjunction with the swing operation of the carbody 4.

From the foregoing explanation, many modifications and other embodiments of the present invention are obvious to one skilled in the art. Therefore, the foregoing explanation should be interpreted only as an example and is provided for the purpose of teaching the best mode for carrying out the present invention to one skilled in the art. The structures and/or functional details may be substantially modified within the scope of the present invention.

REFERENCE SIGNS LIST

1, 1A, 1B bogie
2 railcar
4 carbody
11 bogie frame
13 axle
16 bearing
17 axle box
18 axle box suspension
21 cross beam
22 axle beam
27 gap body
28 support seat
19
28*a* seat surface
34 plate spring
34*a* car longitudinal direction middle portion of plate spring
34*b* car longitudinal direction end portion of plate spring
40, 40A, 40B interlock mechanism
41, 41A support seat-side bracket
42, 42A, 42B link member
43, 43A bogie frame-side bracket
44, 44A support seat-side shaft member (pin member)
44*a* spherical bushing
45, 45A bogie frame-side shaft member (pin member)
45*a* spherical bushing
46 bolster beam
50 steering mechanism

The invention claimed is:

1. A railcar steering bogie comprising:

a bogie frame including a cross beam supporting a carbody;

a pair of axles arranged along a car width direction;

a plurality of axle boxes accommodating a respective plurality of bearings rotatably supporting the respective axles;

a plurality of axle box suspensions each including a coupling member coupling the corresponding axle box and the bogie frame while allowing relative displacement of the bogie frame and the axle box in a car longitudinal direction;

a plate spring extending in the car longitudinal direction, the plate spring including (i) both car longitudinal direction end portions extending obliquely upward along the car longitudinal direction and supported above the respective axle boxes, and (ii) a car longitudinal direction middle portion arranged under the cross beam so as not to be fixed to the cross beam;

a plurality of support seats including respective inclined upper surfaces and supporting the both respective longitudinal direction end portions of the plate spring; and a plurality of gap bodies each provided between an upper surface of the corresponding axle box and a lower surface of the corresponding support seat, the plurality of gap bodies being configured to allow displacement of the corresponding axle box and the support seat in the car longitudinal direction, each of the plurality of gap bodies being an elastic member including upper and lower surfaces, the upper and lower surfaces including respective horizontal surfaces, the elastic member being elastically deformable in a horizontal direction.

2. The railcar steering bogie according to claim 1, further comprising a steering mechanism configured to steer at least one of the pair of axles, wherein:

the bogie frame supports the carbody or a bolster such that the carbody or the bolster is swingable relative to the bogie frame about a vertical axis; and the steering mechanism displaces the corresponding axle box in the car longitudinal direction to steer the axle in accordance with the swinging of the carbody or the bolster relative to the bogie frame.

3. A railcar steering bogie comprising:

a bogie frame including a cross beam supporting a carbody;

a pair of axles arranged along a car width direction;

a plurality of axle boxes accommodating a respective plurality of bearings rotatably supporting the respective axles;

a plurality of axle box suspensions each including a coupling member coupling the corresponding axle box and the bogie frame while allowing relative displacement of the bogie frame and the axle box in a car longitudinal direction;

a plate spring extending in the car longitudinal direction, the plate spring including (i) both car longitudinal direction end portions extending obliquely upward along the car longitudinal direction and supported above the respective axle boxes, and (ii) a car longitudinal direction middle portion arranged under the cross beam so as not to be fixed to the cross beam;

a plurality of support seats including respective inclined upper surfaces and supporting the both respective longitudinal direction end portions of the plate spring;

a plurality of gap bodies each provided between an upper surface of the corresponding axle box and a lower surface of the corresponding support seat, the plurality of gap bodies being configured to allow displacement of the corresponding axle box and the support seat in the car longitudinal direction; and an interlock mechanism coupling the bogie frame and the corresponding support seat, the interlock mechanism being configured to move the support seat in the car longitudinal direction in accordance with a movement of the corresponding car longitudinal direction end portion of the plate spring in the car longitudinal direction.

4. The railcar steering bogie according to claim 3, wherein:

the interlock mechanism is a link mechanism including a link member rotatably attached to at least one of a support seat-side bracket provided at the corresponding support seat and a bogie frame-side bracket provided at the bogie frame; and when the bogie frame and the bogie frame-side bracket move downward, the link member of the link mechanism displaces the support seat through the support seat-side bracket toward the cross beam in the car longitudinal direction.

5. The railcar steering bogie according to claim 4, wherein:

the link mechanism is configured such that a displacement magnitude x of the support seat is represented by Formulas (1) and (2) below, $$x=D-L\cos\theta \quad (1)$$

$$\theta=\sin^{-1}((H+\delta)/L) \quad (2)$$

where D denotes a car longitudinal direction distance between a turning center of the link member at the support seat-side bracket and a turning center of the link member at the bogie frame-side bracket, H denotes a vertical direction distance between the two turning centers, δ denotes a deflection amount of the plate spring in an upward/downward direction, and L denotes a length of the link member; and the length L of the link member, the car longitudinal direction distance D, and the vertical direction distance H are set such that an absolute value $|x-x_0|$ of a difference between the displacement magnitude x of the support seat with respect to the deflection amount δ and a displacement magnitude $x_o$ of the longitudinal direction end portion of the plate spring with respect to the deflection amount δ becomes 5 mm or less.

6. The railcar steering bogie according to claim 4, wherein:

the link member is rotatably coupled to at least one of the support seat-side bracket and the bogie frame-side bracket through a pin member; and the pin member is attached to the at least one bracket through an adjustment plate.

7. The railcar steering bogie according to claim 6, wherein the pin member includes a spherical bushing supporting the link member such that the link member is swivelable.

8. The railcar steering bogie according to claim 4, wherein:

the link member is a flat plate-shaped member extending in the car longitudinal direction, a width of the flat plate-shaped member in the car width direction being larger than a thickness of the flat plate-shaped member in a vertical direction; and the link member is arranged above the plate spring so as to overlap the plate spring in a plan view.

9. The railcar steering bogie according to claim 3, wherein each of the gap bodies is an elastic member including upper and lower surfaces, the upper and lower surfaces including respective horizontal surfaces, the elastic member being elastically deformable in a horizontal direction.

10. The railcar steering bogie according to claim 3, further comprising a steering mechanism configured to steer at least one of the pair of axles, wherein:

the bogie frame supports the carbody or a bolster such that the carbody or the bolster is rotatable relative to the bogie frame about a vertical axis; and the steering mechanism displaces the corresponding axle box in the car longitudinal direction to steer the respective axle in accordance with the swinging of the carbody or the bolster relative to the bogie frame.

* * * * *